US005664519A

United States Patent [19]

Erskine

[11] Patent Number: 5,664,519

[45] Date of Patent: Sep. 9, 1997

[54] BOAT WINSDHIELD WITH ONE PIECE GASKET

[75] Inventor: Edward J. Erskine, Benson, N.Y.

[73] Assignee: N.A. Taylor Co., Inc., Gloversville, N.Y.

[21] Appl. No.: 603,393

[22] Filed: Feb. 20, 1996

[51] Int. Cl.[6] ..... B63B 17/00

[52] U.S. Cl. ..... 114/361; 296/146.15

[58] Field of Search ..... 114/361; 296/93, 296/146.15, 201; 52/208

[56] References Cited

U.S. PATENT DOCUMENTS

| | | | |
|---|---|---|---|
| 3,016,548 | 1/1962 | Taylor | 114/361 |
| 3,810,267 | 5/1974 | Fussell, Jr. et al. | 114/361 |
| 3,843,982 | 10/1974 | Lane et al. | 114/361 |
| 4,140,470 | 2/1979 | Pasch et al. | 425/544 |
| 4,750,449 | 6/1988 | Muhlberger | 114/361 |
| 4,902,215 | 2/1990 | Seemann, III | 425/406 |
| 4,966,092 | 10/1990 | Illingworth | 114/343 |
| 5,178,885 | 1/1993 | Vallier et al. | 425/117 |
| 5,225,174 | 7/1993 | Gold | 296/93 |
| 5,269,250 | 12/1993 | Daniels | 114/361 |
| 5,339,763 | 8/1994 | Erskine | 114/361 |

*Primary Examiner*—Jesus D. Sotelo
*Attorney, Agent, or Firm*—Nixon & Vanderhye P.C.

[57] ABSTRACT

A boat windshield, and labor saving method of manufacturing the boat windshield, are provided. The conventional components of a generally polygonal configuration frame, a piece of boat windshield sheet material that is transparent, and a mechanism for connecting the frame to a boat so as to construct a boat windshield are utilized. However the flexible gasket material that is provided in an inwardly facing channel of the frame, instead of being a number of discrete pieces which are cut and fit together at the corners, comprises an integral single piece of flexible (preferably elastomeric) material having continuous and integral corners corresponding to and disposed within the channels of the frame, the corners between the frame sides. The integral gasket corners are preferably produced by transfer molding. Only a small amount of caulk is used at the frame corners.

20 Claims, 2 Drawing Sheets

26
20
13
24
11
10
18
23
27
17
16
14
12
25
21

BOAT WINSDHIELD WITH ONE PIECE GASKET

BACKGROUND AND SUMMARY OF THE INVENTION

Boat windshields are conventionally made (for example see U.S. Pat. Nos. 4,750,449 and 3,810,267), using a frame which is sealed to glass or other transparent material. The frame is constructed (typically of metal, such as aluminum, extrusions) having a number of sides which define an inwardly facing channel, with corners between the sides, and having a generally polygonal configuration (typically triangular, quadrate, or trapezoidal). A piece of substantially rigid or semi-rigid transparent boat windshield material (of glass, tempered glass, acrylic, plastic, or the like) is held to the frame by a flexible gasket material disposed in the channel on each of the sides of the frame. Typically the gasket material is cut and fit at the joints (corners) during construction of the windshield, a highly labor intensive process. This requires a significant amount of caulk to be provided at the corners in order to facilitate sealing of the windshield material so that water will not pass between the frame corners, and between the frame and the gasket material, but even with a large amount of caulk, because of the cut and fit nature of the joints adjacent the corners the seal provided is not leakproof, and has a tendency to degrade with time, vibration and/or shipping and installation stresses.

According to the present invention the labor costs associated with the manufacture of boat windshields as described above can be significantly reduced in a very simple way. At the same time a more leakproof seal, which will not significantly degrade with time, vibration, and/or shipping and installation stresses, is provided. These significant advantages are achieved according to the present invention merely by substituting a flexible gasket material which comprises an integral, single piece of material (typically elastomeric material) having continuous and integral corner interfaces corresponding to and disposed within the channel of the frame with the corners between the frame sides. Typically the gasket material body sections are extrusions and the corners are transfer molded (transfer molding being a well known process, per se, for molding plastic materials, particularly elastomeric articles such as gaskets, such as described in U.S. Pat. No. 4,140,470 and the art cited therein) so that the body sections are integral at the corners.

Therefore, according to one aspect of the present invention a boat windshield is provided comprising the following components: A frame having at least first and second (and typically also third) sides each of which defines an inwardly facing channel, and corners between the sides, (e.g. the frame having a generally polygonal configuration). A flexible gasket material disposed in the channel of each of the sides of the frame. A piece of substantially rigid or semi-rigid transparent boat windshield sheet material received by the flexible gasket material, with the frame surrounding the gasket material and windshield material, for sealing the windshield material so that water substantially will not pass between the frame and the gasket material. The flexible gasket material comprises an integral single piece of material having continuous and integral corner interfaces corresponding to and disposed within the channel of the frame, the gasket corners at the frame corners between the frame sides. And means for connecting the frame to a boat, so that the frame, gasket, and windshield material define a boat windshield.

The means for connecting the frame to a boat may be a conventional integral extrusion portion of the frame (of any configuration, including as in Muhlberger U.S. Pat. No. 4,750,449), an extra component attached to one or more frame sides by adhesive, clamps, or mechanical fasteners, or the plain frame itself where the frame is fit into a channel on a boat and clamped and/or screwed in place.

Preferably the gasket material is (as conventional) elastomeric, such as natural or synthetic rubber compounds (which are thermosetting materials) or flexible polyvinyl chloride (or like thermoforming materials). The gasket material corners are preferably transfer molded while the body sections are extrusions. The frame may comprise three sides and the gasket is then substantially triangular in configuration, or the frame may comprise four sides and the gasket is substantially quadrate (rectangular or square) or trapezoidal in configuration; or a larger number of frame sides may be provided; and the frame sides need not be linear (e.g. may be curved or semicircular). Typically only a small amount of caulk is provided between the frame corners to seal the corners of the frame, although according to the present invention it may be possible to use no caulk at all. The small amount of caulk according to the present invention should be compared to the conventional boat windshields which have cut and fit joints where the amount of caulk provided therein is three or more times the volume of the small amount of caulk provided according to the invention. That is, the small amount of caulk used according to the present invention is about a third or less of the amount of caulk conventionally used in cut and fit gasket joints.

According to another aspect of the present invention a labor saving method of manufacturing a windshield from a frame having a plurality of sides with an inwardly facing channel at each side, a transparent substantially or semi-rigid piece of windshield material (e.g. glass), and an integral one piece gasket of flexible (e.g. elastomeric) material and having integral corners, is provided. The method comprises the following steps: (a) Forming an integral one piece gasket of flexible material and having integral corners. (b) Fitting the piece of transparent windshield material into operative connection with the gasket so that the one piece gasket surrounds the exterior of the windshield material. And (c) without having to cut and fit the gasket material corners, inserting the gasket material into the inwardly facing channels of each of the frame sides so that the gasket substantially prevents water from passing between the frame and transparent windshield material in a completed boat windshield.

Step (a) is typically practiced by placing the extruded body sections in a transfer mold, and by injecting elastomeric material into the transfer mold to effect transfer molding of the corners of the flexible (preferably elastomeric) material integral with the body sections. There is also typically the further step of connecting the frame to a boat so that the frame, gasket and windshield material function as a boat windshield. There is also the further step of placing a small amount of, caulk at the frame corners. Step (c) is typically practiced by assembling a plurality of distinct frame side elements into a substantially polygonal frame, and fastening the frame side elements together.

The invention also relates to a boat windshield mounted on a boat and constructed by the process as described above, and including installation of the windshield on a boat.

It is a primary object of the present invention to provide a simple, advantageous, labor saving method of producing a boat windshield, and boat windshield, which boat windshield is more leakproof than conventional boat windshields having cut and fit gasket joints, and has a seal that will not significantly degrade with time, vibration, and/or shipping and installation stresses (which degradation commonly occurs in conventional boat windshields with cut and fit gasket joints). This and other objects of the invention will become clear from an inspection of the detailed description of the invention and from the appended claims.

DETAILED DESCRIPTION OF THE DRAWINGS

Figure 1:
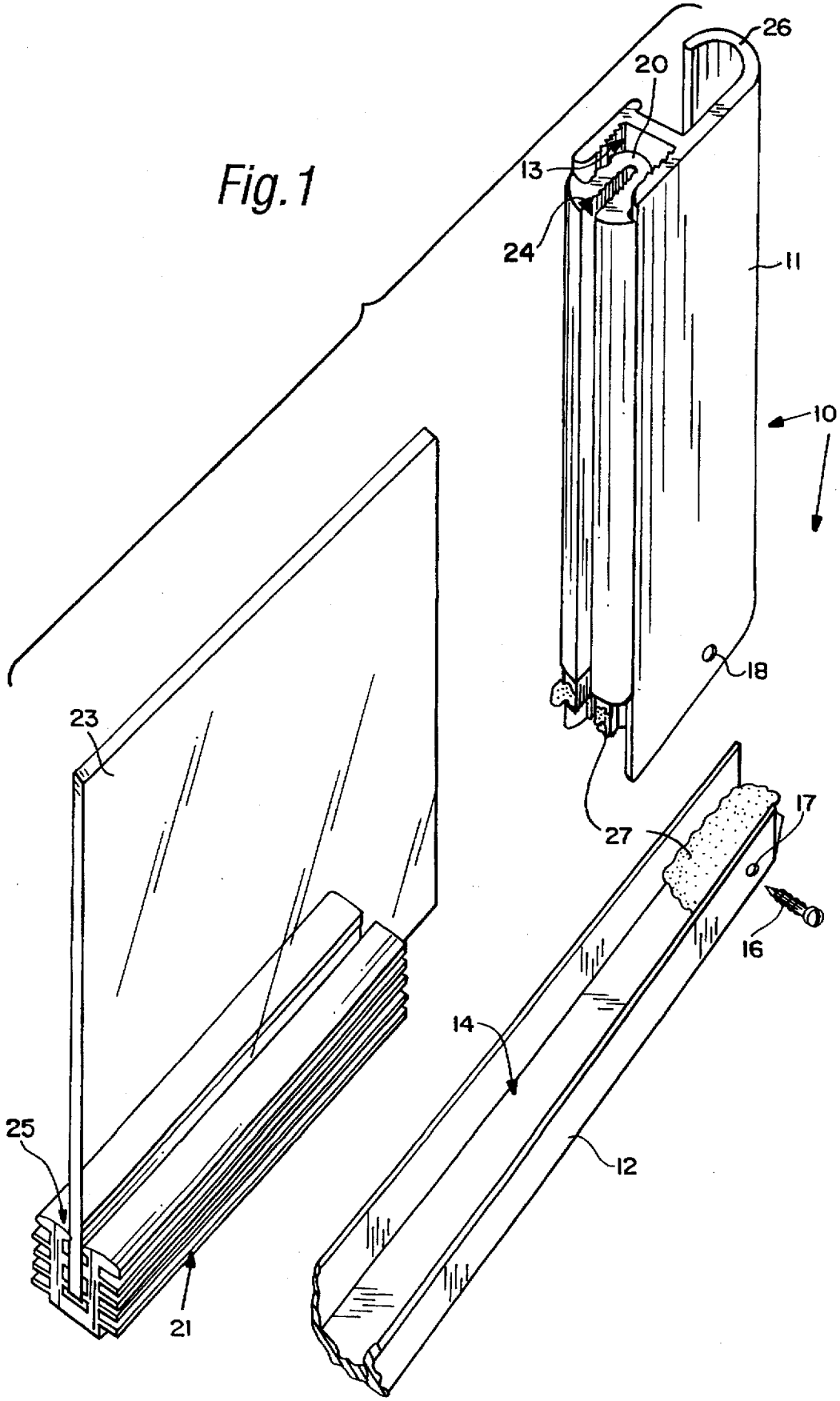
FIG. 1 is a exploded perspective view of a conventional boat windshield construction, at a corner thereof.

FIG. 1 illustrates the corner configuration of a conventional boat windshield configuration, the boat windshield shown installed as in prior art patents such as U.S. Pat. Nos. 4,750,449 and 3,810,267. The prior art windshield of FIG. 1 includes a frame 10, typically having at least first, second and third sides, such as the sides 11, 12 illustrated in FIG. 1, although only two (curved or semicircular) sides or more than three sides (e.g. four, five, or more) may be provided. Each of the sides (e.g. 11, 12) defines an inwardly facing channel, shown schematically by reference numerals 13 and 14 for the frame sides 11 and 12 in FIG. 1. The frame sides 11, 12, etc., typically are metal extrusions (e.g. of aluminum), but can be extrusions of hard plastic, or otherwise manufactured from metal or other available materials. Typically the frame sides 11, 12, etc. are held together at the corners of the boat windshield formed thereby, such as by conventional screws 16 passing through the openings 17, 18 in the frame sides 12, 11, respectively.

The conventional boat windshield of FIG. 1 also includes a flexible gasket material, typically configured as a number of pieces, such as the pieces 20, 21 illustrated in FIG. 1. The gasket material pieces 20, 21 are disposed in the channels 13, 14 of each of the sides of the frame. For example, FIG. 1 shows the gasket material 20 disposed in the channel 13 of the frame side 11, whereas the gasket 21 can fit into the channel 14 of the element 12. The gasket material 20, 21 typically is elastomeric, such as flexible pvc, or natural or synthetic rubber compounds.

The prior art windshield such as illustrated in FIG. 1 also includes a conventional piece of substantially rigid or semi-rigid transparent boat windshield sheet material 23 which is received by the flexible gasket material 20, 21 (for example in slots 24, 25 thereof). The material 23 typically is glass, tempered glass, acrylic, or plastic. The frame 10 surrounds the gasket material (20, 21 ) and windshield sheet material 23, for sealing the windshield material 23 so that —theoretically—water cannot pass between the frame 10 and the sheet material 23.

The conventional boat windshield such as illustrated in FIG. 1 also typically includes means for connecting the frame 10 to a boat so that the frame 10, gasket 20, 21, and windshield material 23 define a boat windshield. The means for connecting the frame 10 to a boat may be a conventional integral extrusion portion 26 of the frame 10 (of any configuration, including as in Muhlberger U.S. Pat. No. 4,750,449), an extra component attached to one or more frame sides by adhesive, clamps, or mechanical fasteners, or the plain frame 10 itself where the frame is fit into a channel on a boat and clamped and/or screwed in place.

While the construction of FIG. 1 has been used for decades (with advances in materials and configurations of the various elements), there always have been problems associated with the manufacture thereof and the final product. For example, the method of manufacture is labor intensive. A significant labor intensive component is the fact that the gasket material 20, 21 must be cut and fit at the joints (the corners to be formed by the elements 11, 12). Not only is this a time consuming process, but the seal provided at the corner is far from leakproof, requiring the application of a large amount of caulk 27 to attempt to enhance the seal at the corner (the caulk for sealing both the frame elements 11, 12 at the corner, and the gasket material elements 20, 21 thereat). Also because of the cut and fit nature of the gasket components 20, 21 at the corner joints, the seal provided thereby (even with caulk) significantly degrades with time, vibration, and/or shipping and installation stresses.

Figure 2:
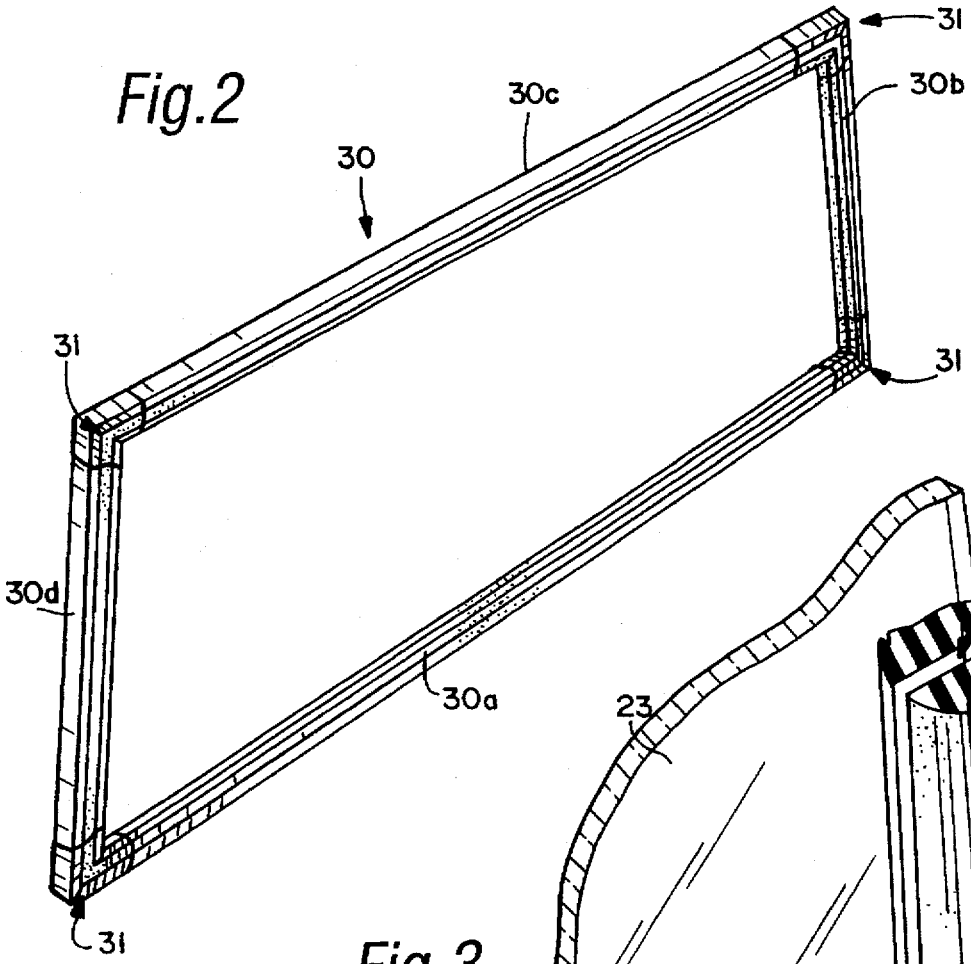
FIG. 2 is a top perspective view of an exemplary integral single piece of gasket material according to the invention, having continuous and integral corner interfaces.
Figure 3:
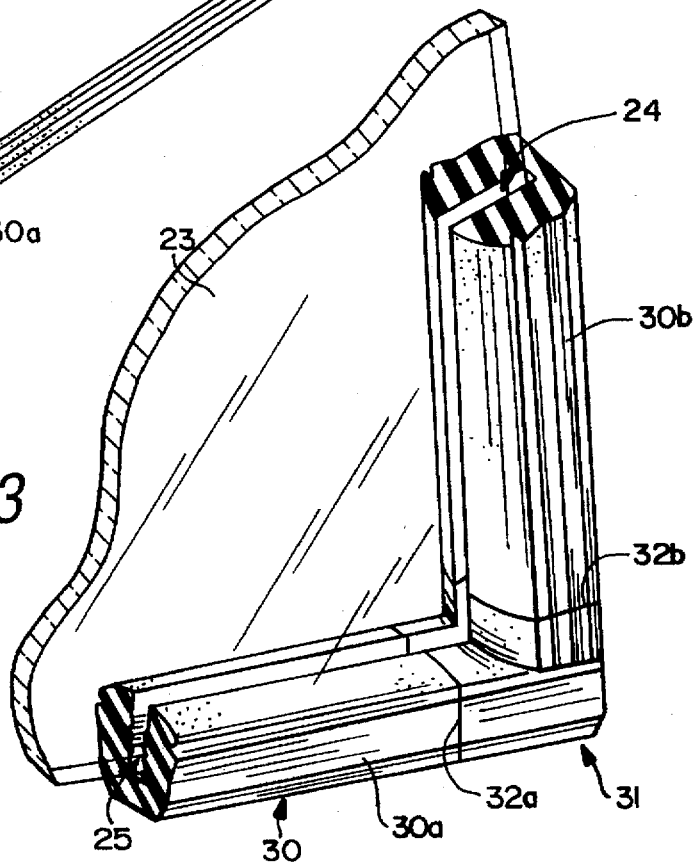
FIG. 3 is a top perspective detail view of one corner of the gasket of FIG. 2 shown holding a piece of windshield sheet material (glass)

According to the present invention the primary difference between the boat windshield of the invention compared to that illustrated in FIG. 1 is the configuration of the gasket material. As illustrated in FIG. 2 for a trapezoidal shaped boat windshield, the flexible gasket material according to the invention comprises an integral single piece 30 (typically of elastomeric material) having continuous and integral corner interfaces—such as shown schematically at 31—corresponding to and disposed within the channel (e.g. 13, 14 in the FIG. 1 embodiment) of the frame 10, the corners 31 between the frame sides (that is, at the interface between the frame side elements 11, 12 of the embodiment of FIG. 1 ). While the integral gasket 30 may be constructed by a number of different techniques, including by ultrasonically welding or otherwise attaching discrete components together, or by other different conventional molding techniques such as splice molding, preferably according to the present invention the integral corners 31 of the integral gasket are formed by transfer molding the corners 31 to the extruded body sections (e.g. **30*a*–30*d* in FIG. 2), using conventional transfer molding techniques. FIG. 3 illustrates in detail one of the corners 31 of the gasket 30 showing the integral nature thereof as produced by the transfer molding process. FIG. 3 also shows a piece of windshield material (such as glass) 23 disposed in the channels 24, 25 of the gasket 30**.

The body sections **30*a*–30*d* are typically extruded out of elastomeric material, such as synthetic rubber or flexible pvc. The sections 30*a*–30*d* may all be of the same size. However, in the embodiment illustrated in FIGS. 2 and 3 the "vertical" (in use) sections 30*b* and 30*d* are illustrated as slightly larger (although the channel 25 size is the same) than the "horizontal" sections 30*a* and 30*c*. This allows the frame components 11, 12 to overlap each other, allowing ready attachment using the screw 16 and openings 17, 18 as seen in FIG. 1, the channel 14 receiving section 30*b* for example, and the channel 13 receiving 30*a* for example. The transfer molding process is particularly simple and effective (both from the cost and functionality standpoints) because the extruded sections 30*a*–30*d* need not be closely dimensioned and accurately cut prior to formation of the corners 31. That is the positions of the ends 32*a*, 32*b* (see FIG. 3) of the extrusions 30*a*, 30*b*, respectively, may be rough cut, and the lengths of the sections 30*a*, 30*b* need not be exact. The ends 32***a*, 32*b* are merely positioned in the transfer mold and the elastomeric material that forms the corner 31 is blasted into the mold, becoming upon setting fully integral with the sections 30*a*, 30*b* at the ends 32*a*, 32*b* thereof, and filling the entire volume between the ends 32*a*, 32*b*. This readily accommodates sections 30*a*, 30*b* of different size, e.g. as illustrated in FIG. 3 the section 30*b* being significantly larger than the section 30*a*, the corner 31 formed by transfer molding providing a smooth transition between them.

While transfer molding is definitely preferred, alternatively, the ends of the sections 30*a*–30*d* could be mitered or otherwise shaped to conform to each other at the corners, e.g. for splice molding, or for ultrasonic welding.

Other than the integral nature of the gasket 30 described above, the boat windshield according to the present invention is substantially as illustrated in FIG. 1. There is one other difference—the amount of caulk used is significantly less than in the prior art of FIG. 1. Rather than the large amount of caulk 27 being necessary only a small amount (that is about one-third or less of that necessary for the prior art as illustrated in FIG. 1) is provided since the caulk need seal only the frame sections (e.g. 11, 12) corners, or under some circumstances no caulk is needed. The gasket material 30 according to the present invention seals the windshield material 23 with respect to the frame 10 so that water substantially will not pass between the frame 10 and the windshield material 23.

Figure 4:
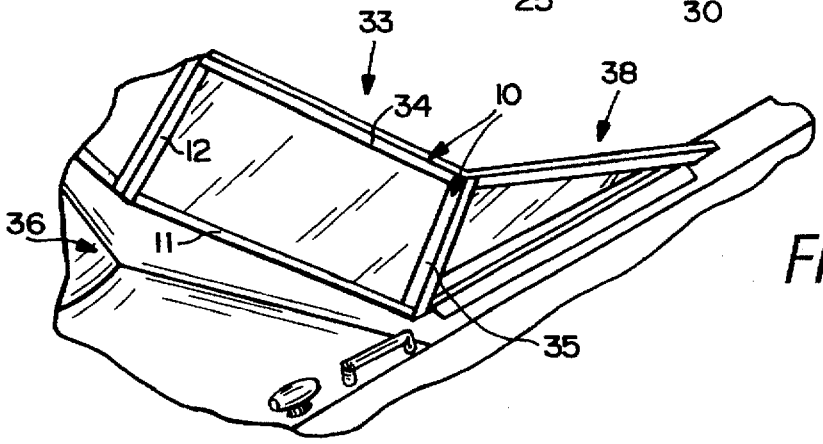
FIG. 4 shows different forms of boat windshield sections according to the invention actually installed on a boat.

FIG. 4 illustrates two different standard configurations of boat windshields, but produced according to the present invention, although two sections, or five or more section frames may also be utilized.

The boat windshield section illustrated generally by reference numeral 33 in FIG. 4 is a substantially trapezoidal section produced utilizing the gasket 30 as illustrated in FIG. 2, and having a frame 10 formed by four different sides in a trapezoidal configuration such as the sides 11, 12, 34, and 35. In this particular embodiment, the frame 11 is connected to the boat 36 by fasteners passing through the integral extrusion portion 26 thereof, although other connecting means—as described above—may be utilized.

FIG. 4 also illustrates a boat windshield configuration 38 according to the present invention which is the same as that illustrated as windshield section 33 except that it is triangular in configuration rather than trapezoidal. In this case then the gasket material 30 would have a triangular configuration corresponding to the shape of the windshield section 38 as illustrated in FIG. 4, but again integral (e.g. transfer molded) corners.

Because of the integral nature of the corners 31 of the gasket material 30 according to the present invention a much more leakproof seal is provided than in the prior art of FIG. 1, and the seal does not significantly degrade with time, vibration, and/or shipping and installation stresses, or the like. Therefore, according to the present invention an advantageous boat windshield and method of manufacturing a boat windshield have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A boat windshield comprising:

a frame having at least first and second sides each of which defines an inwardly facing channel, and corners between said sides;

a flexible gasket material disposed in said channel of each of said sides of said frame;

a piece of substantially rigid or semi-rigid transparent boat windshield sheet material received by said flexible gasket material, with said frame surrounding said gasket material and windshield material, for sealing said windshield material so that water substantially will not pass between said frame and said sheet material;

said flexible gasket material comprises an integral single piece of material having continuous and integral transfer molded corner interfaces corresponding to and disposed within said channel of said frame, said gasket corners at said frame corners between said frame sides; and means for connecting said frame to a boat, so that said frame, gasket, and windshield material define a boat windshield.

2. A boat windshield as recited in claim 1 wherein said gasket material, including said corners, is elastomeric material.

3. A boat windshield as recited in claim 2 wherein said frame comprises three sides, and said gasket is substantially triangular in configuration.

4. A boat windshield as recited in claim 2 wherein said frame comprises four sides, and said gasket is substantially quadrate or trapezoidal in configuration.

5. A boat windshield as recited in claim 1 further comprising a small amount of caulk between said frame corners.

6. A boat windshield as recited in claim 1 wherein said gasket material is elastomeric material, comprising a plurality of extruded body sections integrally connected at said corners.

7. A boat windshield as recited in claim 6 wherein said frame sections at one of said frame corners are of different size so that they overlap, and wherein said gasket body sections at said one corner are also of different size, fitting within said respective frame channels, and said transfer molded corners providing a transition therebetween.

8. A boat windshield as recited in claim 1 wherein said frame comprises at least three sides, and said frame and gasket are both substantially polygonal in configuration.

9. A boat windshield as recited in claim 1 wherein said flexible gasket material, including at said corners, comprises thermosetting or thermoforming elastomeric material.

10. A labor saving method of manufacturing a boat windshield from a frame having a plurality of sides with an inwardly facing channel of each side, a transparent substantially rigid or semi-rigid piece of windshield material, and an integral one piece gasket comprising a plurality of extruded body sections of flexible material and having integral corners, said method comprising the steps of:

(a) forming an integral one piece gasket of flexible material and having integral corners by fitting the extruded body sections together in a transfer mold and by injecting flexible material into the transfer mold to effect transfer molding of the corners of the gasket so that the corners are integral with the body sections;

(b) fitting the piece of transparent windshield material into operative connection with the gasket so that the one piece gasket surrounds the exterior of the windshield material; and (c) without having to cut and fit the gasket material corners, inserting the gasket material into the inwardly facing channels of each of the frame sides so that the gasket substantially prevents water from passing between the frame and transparent windshield material in a completed boat windshield.

11. A method as recited in claim 10 wherein step (a) is practiced using elastomeric material as the flexible gasket material, including for the transfer molded corners.

12. A method as recited in claim 10 comprising the further step of connecting the frame to a boat so that the frame, gasket and windshield material function as a boat windshield.

13. A method as recited in claim 10 comprising the further step of placing only a small amount of caulk between the frame corners.

14. A method as recited in claim 10 wherein step (c) is also practiced by assembling a plurality of distinct frame side elements into a substantially polygonal shaped frame, and fastening the frame side elements together.

15. A method as recited in claim 10 wherein step (a) is further practiced by using different size extrusions at at least one of the corners prior to transfer molding, the transfer molded corner at the at least one corner providing a transition between the extrusions.

16. A method as recited in claim 15 comprising the further step of connecting the frame to a boat so that the frame, gasket and windshield material function as a boat windshield.

17. A method as recited in claim 16 wherein step (c) is also practiced by assembling a plurality of distinct frame side elements into a substantially polygonal shaped frame, and fastening the frame side elements together.

18. A method as recited in claim 17 comprising the further step of placing only a small amount of caulk between the frame corners.

19. A method as recited in claim 18 wherein step (a) is practiced using elastomeric material as the flexible gasket material, including for the transfer molded corners.

20. A boat windshield mounted on a boat and constructed from a frame having a plurality of sides with an inwardly facing channel of each side, a transparent substantially rigid or semi-rigid piece of windshield material, and an integral one piece gasket of flexible material formed by extruded body sections and having integral corners, the windshield constructed by a method comprising the steps of:

(a) placing the extruded body sections into a transfer mold and transfer molding the corners so that they are integral with the body sections so that a one piece gasket is produced;

(b) fitting the piece of transparent windshield material into operative connection with the gasket so that the one piece gasket surrounds the exterior of the windshield material;

(c) without having to cut and fit the gasket material corners, inserting the gasket material into the inwardly facing channels of each of the frame sides so that the gasket substantially prevents water from passing between the frame and transparent windshield material in a completed boat windshield; and (d) installing the windshield on a boat.

* * * * *